US005370189A

United States Patent [19]

Deist

[11] Patent Number: 5,370,189

[45] Date of Patent: Dec. 6, 1994

[54] FIRE EXTINGUISHER BOTTLE WITH PICK-UP TUBE

[76] Inventor: Jimmie F. Deist, 641 Sonora Ave., Glendale, Calif. 91201

[21] Appl. No.: 44,728

[22] Filed: Apr. 13, 1993

[51] Int. Cl.[5] ..... A62C 3/07

[52] U.S. Cl. ..... 169/62; 169/72; 169/74; 285/269

[58] Field of Search ..... 169/62, 72, 74; 285/268, 269

[56] References Cited

U.S. PATENT DOCUMENTS 412,940 10/1889 Aldcorn ..... 285/269

FOREIGN PATENT DOCUMENTS 2217593 11/1989 United Kingdom ..... 169/62

2255015 10/1992 United Kingdom ..... 169/62

*Primary Examiner*—Daivd M. Mitchell

*Assistant Examiner*—Andrew C. Pike

*Attorney, Agent, or Firm*—Allan M. Shapiro

[57] ABSTRACT

The fire extinguisher bottle is intended for a vehicle or other moving structure and is clamped in a horizontal position. The outlet is ducted to locations where the fire extinguisher fluid may be required, such as the engine compartment and/or passenger compartment. The pick-up tube in the bottle is ball-and-socket mounted so that it is gravitationally carried to the bottom of the bottle no matter what the vehicle orientation.

10 Claims, 1 Drawing Sheet

FIRE EXTINGUISHER BOTTLE WITH PICK-UP TUBE

FIELD OF THE INVENTION

This invention is directed to a fire extinguisher bottle particularly useful for race cars and other vehicles where upset may occur, together with a ball-and-socket mounted pick-up tube which is pulled to the gravitational bottom of the bottle.

BACKGROUND OF THE INVENTION

Racing cars carry fire extinguisher bottles therein. The fire extinguisher bottles carry pressurized fire extinguishing material. The bottles are provided with manually operated valves to release the extinguishing material, and the bottles have distribution tubes which distribute the extinguishing material to the engine compartment and the driver compartment. In most cases, these fire extinguisher bottles are clamped in the racing car in a horizontal position when the racing car is in its normal upright position.

In order to obtain delivery of the liquid fire extinguishing material in the bottle, a pick-up tube is provided therein. If it were not for the dynamics of the racing car, the pick-up tube could be fixed so that the pick-up tube inlet is in the bottom of the bottle. However, as can be appreciated with respect to racing cars, if there is an upset, the pick-up tube should still be in the bottom of the bottle. Previously, it has been attempted to mount the pick-up tube on a polymer tube which presumably would be sufficiently flexible to permit the metal pick-up tube to have its suction end lie in the bottom of the fire extinguisher bottle. However, such polymer tubes are not reliable. They may become stiff due to normal aging or exposure to the bottle contents and not permit motion of the inlet end of the tube. They may break so that only a portion of the fire extinguishing fluid in the bottle can be discharged. Thus, the use of a polymer tube does not satisfy safety needs. While this invention is described with respect to a racing car environment, it can be appreciated that the fire extinguisher bottle with pick-up tube in accordance with this invention is useful in other locations where orientation can change.

SUMMARY OF THE INVENTION

In order to aid in the understanding of this invention, it can be stated in essentially summary form that it is directed to a fire extinguisher bottle with a pick-up tube. The fire extinguisher bottle is for mounting in a generally horizontal position, and the outlet end of the pick-up tube is mounted therein on a ball-and-socket joint so that the inlet end of the pick-up tube can gravitationally fall to the bottom of the bottle, whatever its orientation, to permit discharge of fire extinguisher fluid from the bottle with any bottle orientation.

It is, thus, an object and advantage of this invention to provide a fire extinguisher bottle which has a pick-up tube therein with its outlet end mounted on a ball-and-socket joint so that the inlet end of the tube gravitationally falls to the gravitational bottom of the bottle.

It is another object and advantage of this invention to provide a fire extinguisher bottle which is particularly useful in racing cars which require the discharge of fire extinguishing fluid from the fire extinguisher bottle upon detection of a fire, no matter what the bottle orientation.

It is a further object and advantage of this invention to provide a fire extinguisher bottle which has its pick-up tube mounted on a metal-to-metal ball-and-socket joint so that there are no organic materials therein to age, become brittle, or crack so as to provide long-term reliability of the fire extinguisher bottle to discharge its contents no matter what the orientation.

It is a further object and advantage of this invention to provide a pick-up tube mounting in a fire extinguisher bottle wherein the mounting is easy to machine and assemble and, thus, which can be widely available to enhance fire protection for the racing car in which it is installed and the driver thereof.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 1:
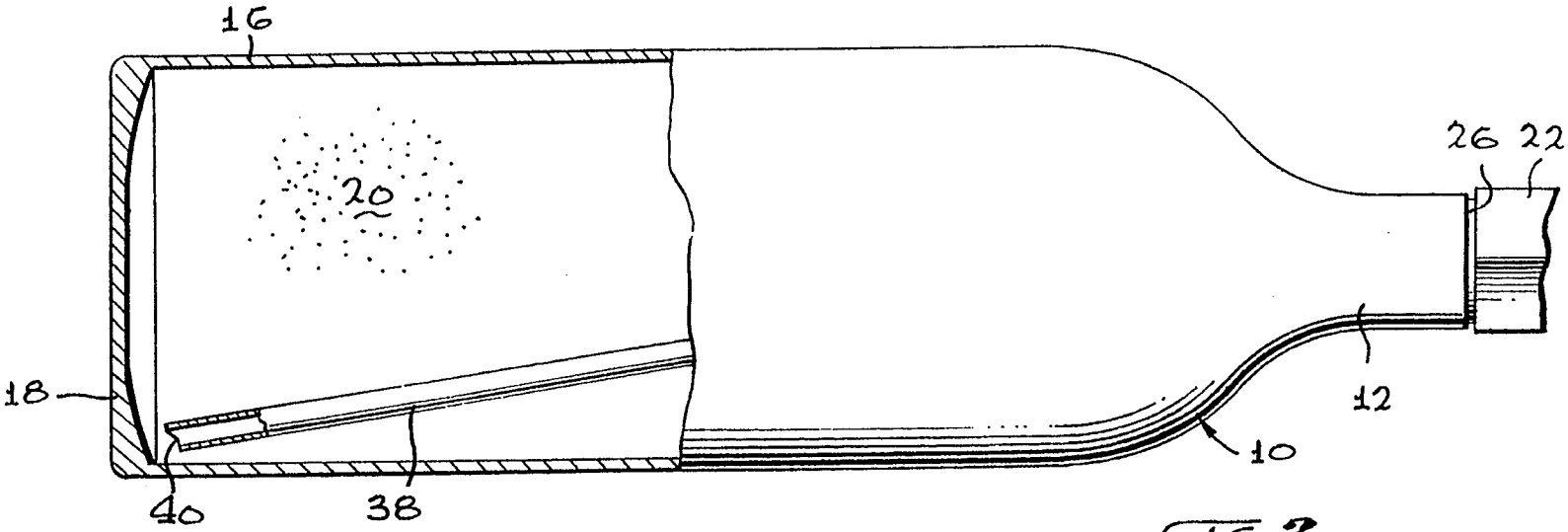
FIG. 1 is a side-elevational view of a fire extinguisher bottle with a pick-up tube, in accordance with this invention, with parts broken away and parts taken in section.

A fire extinguisher bottle is generally indicated at 10 in FIG. 1. It is a closeable bottle with a neck 12, which has internal threads 14. The neck opening is the only opening to the bottle. It has side walls 16 which are in the form of a right circular cylindrical tube. Bottom 18 is formed with the side walls to close the bottle. The bottle has sufficient strength to contain the fire extinguishing liquid 20. The liquid 20 is self-pressurized to be driven from the bottle, or is suitably pressurized by any convenient means. In the present instance, the fire extinguisher bottle is for installation in a racing car, and its purpose is to provide extinguishing material which extinguishes or controls a fire around the engine and fire in the driver's compartment. Halon is a suitable material, and other materials can be used, depending on application.

Fitting 22 has screw threads 24 by which the fitting is screwed into and is retained in the neck 12 of the bottle. O-ring 26 seals the fitting 22 in place. The fitting 22 has a discharge opening 28 therein, shown in dashed lines in FIG. 2. The opening 28 is surrounded by fitting threads 30 so that a release valve may be secured thereto. The release valve acts against the valve seat 32, which is formed at the juncture of opening 28 and outlet passage 34 which extends through the fitting. The valve may be actuated by any convenient means, such as an automatic fire sensor in some applications but, in a racing car, preferably by a push-to-activate switch or actuator which is operated by the driver. The valve has a passage therethrough by which the fire extinguishing material is delivered to the engine compartment. In addition, fitting 22 has an opening 36 by which the fire extinguishing material is connected to be discharged to the driver's compartment.

Figure 2:
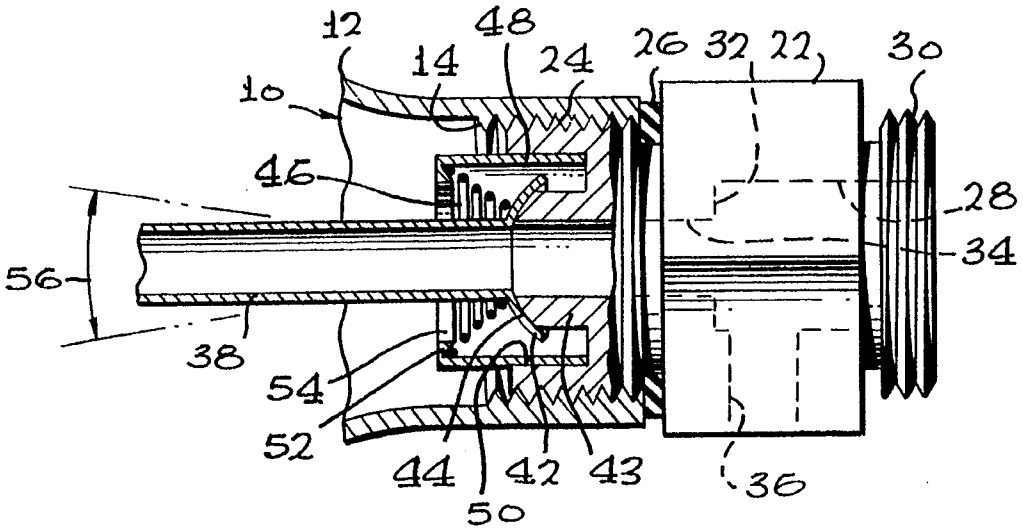
FIG. 2 is an enlarged side-elevational view of the outlet end of the bottle, with parts broken away and parts taken in section, showing the pick-up tube mounting in accordance with this invention.
Figure 3:
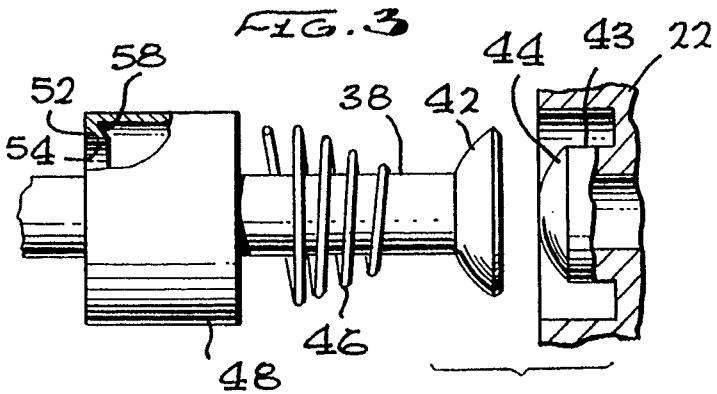
FIG. 3 is a side-elevational view, on the same scale as FIG. 2, showing the pick-up tube mounting in exploded position.

The bottle 10 is shown with its axis horizontal in FIGS. 1, 2, and 3 since it is usually secured horizontally in the race car when the race car is in its normal attitude. Since it is necessary to draw the fire extinguishing liquid 20 from the bottom of the bottle 10 in order to employ most of the fire extinguishing liquid in the bottle, pick-up tube 38 is provided. Pick-up tube 38 has an open inlet end 40, see FIG. 1. The outlet end of the pick-up tube is swaged to form a bell 42 with a spherical interior surface. Fitting 22 has a nose 43 therein which has an external spherical surface 44 of the same radius. The bell 42 lies against the surface 44. The length of the pick-up tube is such that, when engaged in that manner, the pick-up tube just clears the bottom 18, as seen in FIG. 1.

The spherical bell 42 is urged against the spherical surface 44 of the nose by means of conical compression spring 46. Spring retainer 48 is a generally tubular structure which press-fits against the interior surface 50 around the nose 43 in fitting 22. Spring retainer 48 has an annular flange 52 with an interior circular opening 54 which is larger than the pick-up tube 38, see FIGS. 2 and 3. This opening 54 is sufficiently large to permit the pick-up tube to swing from one side of the bottle wall to the other, at least through an angle indicated by arrow 56 in FIG. 2. The retainer flange 52 extends axially as a reentrant ring, and the large end of the conical spring 46 engages in the recess 58 formed by the reentrant ring to as to be retained by the flange 52. The small end of the conical spring is large enough to receive the pick-up tube 38 and is small enough to engage on the bell 42. In this way of coupling the pick-up tube 38 to the fitting 22, the pick-up tube bell 42 is retained against the fitting surface 44 for minimum leakage, together with ease of swinging.

Should the racing car in which the fire extinguisher bottle 20 is installed be upset, the inlet end 40 of the pick-up tube 38 will swing by gravity toward that side of the bottle which is now down. In view of the fact that all of the parts are metal, no deleterious aging of organic parts occurs. The fire extinguisher bottle thus has a pick-up tube which has its inlet end gravitationally swung to the downward portion of the side wall, and reliably does so over a long life.

In some applications of this invention, a weight may be added to the pick-up tube at or near the inlet end to ensure full travel of the tube in all directions. For example, a very short pick-up tube, located in a very short bottle, and/or any size tube moving through a heavy or viscous fluid medium, would benefit from such additional weight.

While this fire extinguisher bottle with the pick-up tube which reliably lies against the bottom side wall has been described with respect to a racing car, it is clear that it is useful in any situation where the fire extinguisher bottle needs to be discharged when it is in different positions. Thus, the described pick-up tube and coupling structure is useful in other environments.

This invention has been described in its presently contemplated best mode, and it is clear that it is susceptible to numerous modifications, modes, and embodiments within the ability of those skilled in the art and without the exercise of the inventive faculty. Accordingly, the scope of this invention is defined by the scope of the following claims.

What is claimed is:

1. A fire extinguisher bottle comprising:

a bottle having a side wall and having an outlet, said bottle being configured to contain fire extinguishing fluid;

a nose in said bottle, said nose having an outlet passage therethrough, said nose having a substantially spherical convex surface thereon directed into said bottle;

a metallic pick-up tube, said pick-up tube having a first end and a second end, said first end of said tube having an inlet opening therein, said second end of said tube having a substantially spherical female surface thereon in engagement with said convex surface on said nose;

a spring retainer engaged adjacent said nose, said spring retainer having an opening therethrough, said spring retainer being positioned around said pick-up tube, said opening of said spring retainer being larger than said pick-up tube so that said pick-up tube can swing on its spherical surface; and a spring within said spring retainer, said spring retainer having a reentrant ring thereon and said spring having a large end and a small end, the large end of said spring engaging in said reentrant ring of said spring retainer and said small end of said spring engaging around said pick-up tube so that said pick-up tube can swing on said substantially spherical convex surface so that its first end is gravitationally moved downward within said bottle.

2. The fire extinguisher bottle of claim 1 wherein there is a fitting engaged in said outlet in said bottle and said nose is in said fitting.

3. The fire extinguisher bottle of claim 2 wherein said spring retainer is engaged on said fitting.

4. The fire extinguisher bottle of claim 3 wherein there is a cylindrical spring retainer surface within said fitting around said nose and said spring retainer is engaged and retained in said fitting on said spring retainer surface.

5. The fire extinguisher bottle of claim 4 wherein said fitting has outlets configured to deliver fire extinguisher fluid to at least two locations.

6. A fire extinguisher bottle comprising:

a bottle having interior and exterior walls of substantially cylindrical tubular configuration throughout a substantial portion of its length and having a bottom and having a neck opposite said bottom, said bottle being configured to retain pressurized fire extinguisher fluid, said neck having an outlet lying substantially on the cylindrical axis of said bottle;

a fitting attached to said neck of said bottle and sealed with respect thereto, said fitting having an opening therethrough for discharge of the fire extinguisher fluid in said bottle, said fitting having a nose thereon, said opening extending through said nose, said nose having a substantially spherical surface thereon;

a metallic pick-up tube having a first end and a second end, said first end of said pick-up tube having an inlet opening and said second end of said pick-up tube having a bell thereon having a substantially spherical surface, said substantially spherical surfaces of said nose and said bell being engaged upon each other so that said tube can swing within said bottle with respect to said fitting; and a spring retainer around said nose, said retainer having a retainer opening therethrough, said pick-up tube extending through said retainer opening, and a spring in said retainers, said spring surrounding said pick-up tube, said spring engaging said retainer and said bell on said pick-up tube to thrust said spherical surface within said bell against said spherical surface on said nose, said spring being a compression spring having a large end and a small end, said opening in said retainer being sufficiently large so that said first end of said pick-up tube can gravitationally swing against said interior wall of said body.

7. The fire extinguisher bottle of claim 6 wherein said spring retainer has a reentrant ring therein, the large end of said spring being engaged on said reentrant ring and the small end of said compression spring being engaged against said bell on said second end of said pick-up tube.

8. The fire extinguisher bottle of claim 7 wherein said fitting has a surface therein facing said nose, said spring retainer being engaged on said surface of said fitting to retain said spring retainer with respect to said fitting.

9. A fire extinguisher bottle comprising:

a bottle having side walls, said bottle having a bottom, said bottle having an outlet opening, said bottle being configured to retain fire extinguisher fluid under pressure and being configured to lie with one of said side walls in a downward direction;

a fitting in said outlet opening of said bottle, a nose in said fitting facing into said bottle, an outlet opening extending through said fitting and through said nose, said nose having a spherical surface facing into said bottle;

a spring retainer secured to said fitting;

a metallic pick-up tube in said bottle, said pick-up tube having a first end and a second end, said first end of said pick-up tube having an inlet opening thereon and said second end of said pick-up tube having a bell thereon having a spherical surface, said spherical surface on said bell and said spherical surface on said nose being of substantially the same radius, said spring retainer having an opening therein larger than said pick-up tube so that said pick-up tube can swing on its spherical surface within said opening in said spring retainer; and a compression spring having a large end and having a small end engaging around said pick-up tube, said small end engaging said bell on said second end of said pick-up tube and said large end engaging said spring retainer for resiliently retaining said pick-up tube on said nose so that said first end of said pick-up tube can gravitationally fall within said bottle to said bottle side walls to permit liquid gravitationally downward in said bottle to be delivered through said pick-up tube and out of said fitting.

10. The fire extinguisher bottle of claim 9 wherein said spring retainer has a reentrant ring thereon directed toward said tube and said large end of said compression spring engages on said reentrant ring of said spring retainer.

* * * * *